US008865059B2

(12) United States Patent
Nishiyama et al.

(10) Patent No.: US 8,865,059 B2
(45) Date of Patent: Oct. 21, 2014

(54) CASE FOR ROLLING POWDER ALLOY AND METHOD FOR PRODUCING ROLLED MATERIAL

(75) Inventors: Toshimasa Nishiyama, Tokyo (JP); Hideki Hommo, Niigata (JP); Tsutomu Komata, Niigata (JP)

(73) Assignee: Nikkeikin Aluminum Core Technology Company Ltd., Tokyo (JP)

( * ) Notice: Subject to any disclaimer, the term of this patent is extended or adjusted under 35 U.S.C. 154(b) by 748 days.

(21) Appl. No.: 12/531,990

(22) PCT Filed: Mar. 11, 2008

(86) PCT No.: PCT/JP2008/054396

§ 371 (c)(1),
(2), (4) Date: Sep. 18, 2009

(87) PCT Pub. No.: WO2008/114651

PCT Pub. Date: Sep. 25, 2008

(65) Prior Publication Data

US 2010/0119401 A1 May 13, 2010

(30) Foreign Application Priority Data

Mar. 19, 2007 (JP) ..... 2007-070734

(51) Int. Cl.
*B22F 3/24* (2006.01)

(52) U.S. Cl.
USPC ..... 419/28; 419/69; 425/78

(58) Field of Classification Search
USPC ..... 419/28, 69; 425/78
IPC ..... B22F 3/18,3/003
See application file for complete search history.

(56) References Cited

U.S. PATENT DOCUMENTS 7,998,401 B2 * 8/2011 Okaniwa et al. ..... 419/8

FOREIGN PATENT DOCUMENTS

| | | | |
|---|---|---|---|
| JP | 52-107206 | A | 9/1977 |
| JP | 52-120207 | A | 10/1977 |
| WO | 2006/070879 | | 7/2006 |

* cited by examiner

*Primary Examiner* — Weiping Zhu
(74) *Attorney, Agent, or Firm* — Squire Patton Boggs (US) LLP

(57) ABSTRACT

A powder alloy rolling case (1) includes a side face configuring member (10) formed like a rectangular frame with two members (10*a*, 10*a*) combined, and surrounding side faces of metal powder (2); an upper lid configuring member (11) provided to cover one opening of the side face configuring member (10), and covering an upper face of the metal powder; and a lower lid configuring member (12) provided to cover the other opening of the side face configuring member (10), and covering a lower face of the metal powder (2), wherein joints (10*b*, 10*b*) between the members (10*a*, 10*a*) configuring member (10) are provided in opposing two side faces out of four side faces of the side face configuring member (10).

7 Claims, 5 Drawing Sheets

CASE FOR ROLLING POWDER ALLOY AND METHOD FOR PRODUCING ROLLED MATERIAL

TECHNICAL FIELD

The present invention relates to a case for rolling a powder alloy (powder alloy rolling case) and a method for producing a rolled material using the case used in producing the rolled material of an aluminum powder alloy by a powder metallurgy process.

BACKGROUND ART

In comparison with an ingot alloy of a metal produced by casting, an aluminum powder alloy has an advantage of capable of making a crystal grain fine, adding other elements more, and further dispersing a reinforcing material uniformly. Therefore, in recent years the usage of the aluminum powder alloy is spreading into such a construction and civil usage, including an automobile, a vehicle, and an aircraft.

Conventionally, an aluminum powder alloy is produced, in a state of being tentatively molded by cold isostatic pressing, hot pressing, or the like; in a state of the tentatively molded powder alloy being accommodated in a container; or in a state of being further sealed in a can or the like and being pressure sintered, by being further hot rolled plastically, thereby being molded into a predetermined shape, and being pressure sintered.

Whereas if a reinforcing material and the like are contained in an aluminum powder alloy, the composite becomes brittle; therefore, according to the conventional processing method, there is a problem that it is difficult to mold the aluminum powder alloy into a desired shape.

Therefore, the applicants suggested a method, which is described in the pamphlet of WO 2006/070879, of producing a rolled material ensuring a plastic workability by hot rolling metal powder after the metal powder is current pressure sintered wholly together with a metal container in a state of the metal powder being accommodated in the metal container, and the method has come into practical use.

In the method of producing such a rolled material, there is used in some instances an object formed like a box, as shown in FIGS. 6A and 6B, by combining four metal plates 111, 112, 113, 114 by means of welding and the like as a metal container 101 accommodating metal powder 102; thereby forming a rectangular frame member 110; and closing an opening of the frame member 110 with lid members 115, 115 consisting of a rectangular metal plate.

However, with respect to the conventional metal container 101, the metal plates 111, 112, 113, 114 are joined at corners where a large force acts in rolling; therefore, when an aluminum powder alloy is rolled, a breakage occurs at the corners (joints) of the frame member 110 and the rolling is not achieved in some instances.

In addition, as shown in FIGS. 6C and 6D, for the purpose of preventing a breakage at a joint between metal plates configuring a frame member, there is used in some instances a frame member 120 integrally molded by doing away with the joint between the metal plates. Whereas, in order to integrally mold the frame member 120, there is a problem that production cost runs up; for example, it is necessary to prepare a large extrusion machine.

DISCLOSURE OF THE INVENTION

Consequently, the inventors have developed the research and development to address the conventional technical problems, and have come to originate the present invention. That is, one aspect of the invention is to provide a powder alloy rolling case which is cheap and is not broken in rolling, and a method for producing a rolled material using the case.

More specifically, the powder alloy rolling case as one aspect of the invention is formed like a box by: a side face configuring member configured to be formed like a rectangular frame by combining a plurality of members, and to surround side faces of metal powder; an upper lid configuring member configured to be provided to cover one opening of the side face configuring member and to cover an upper face of the metal powder; and a lower lid configuring member configured to be provided to cover the other opening of the side face configuring member and to cover a lower face of the metal powder, wherein all joints between the plurality of the members configuring the side face configuring member are provided in opposing two side faces out of four side faces of the side face configuring member.

According to the powder alloy rolling case, because the side face configuring member is configured by combining the members of a shape formable by bending, extrusion, and the like, production cost is cheap. Furthermore, all joints of respective members configuring the side face configuring member are not joined at the corners of the case where a large force acts in rolling, but provided in a pair of side faces which are members configuring sides of the rectangular frame in plan view of the side face configuring member; therefore, it is possible to suppress a breakage of the case in rolling. Moreover, when rolling is performed in a direction intersecting faces where the joints are provided, it is suppressed for the joints to be separated in rolling. That is, when the joints are arranged in faces parallel to a rolling direction, the joints are elongated, and therefore, there is a fear that the joints are separated; whereas, when the joints are arranged in the faces intersecting the elongated direction, stress acting on the joints in rolling is small, and it is suppressed for the members to be separated from each other at the joints.

Furthermore, when the joints are arranged at positions displaced from middles of the side faces in a width direction, respectively, the joints are arranged at the positions which avoid middle portions where larger stress acts; therefore, it is preferably suppressed for the joints to be separated. Here, the width direction of the side faces means a left-to-right direction in front view of opening faces of the side face configuring member formed like a rectangular frame in a state of the side face configuring member being arranged so that the opening faces are arranged to be up and down, respectively.

Moreover, in the metal alloy rolling case, when the side face configuring member, the upper lid configuring member, and the lower lid configuring member are coupled by being fitted with each other, such a trouble of the joints being separated does not occur; therefore, it is preferable.

Furthermore, as one aspect of the invention, a method for producing a rolled material comprises: an accommodation process of accommodating metal powder in a powder alloy rolling case formed like a box by a side face configuring member configured to be formed like a rectangular frame with a plurality of members combined and to surround side faces of metal powder, an upper lid configuring member configured to be provided to cover one opening of the side face configuring member and to cover an upper face of the metal powder, and a lower lid configuring member configured to be provided to cover the other opening of the side face configuring member and to cover a lower face of the metal powder; and a rolling process of rolling the case where the metal powder is accommodated, wherein joints of the side face configuring member are arranged in opposing two side faces out of four side faces of the side face configuring member, and wherein in the rolling process the case is rolled in a direction intersecting the side faces where the joints are formed.

According to the method for producing the rolled material, because the joints between the members configuring the side face configuring member are arranged at positions where stress acting on the joints is small in rolling, it is preferably prevented for the powder alloy rolling case and the like to be broken in rolling.

In the method for producing the rolled material, a process of sintering the powder alloy rolling case where the metal powder is accommodated may also be included after the accommodation process and before the rolling process.

In the method for producing the rolled material, when rolling reinforcing members are fixed to the side faces where the joints are formed, it is preferably possible to efficiently make rolling load act on the powder alloy rolling case, and to easily insert the case in an apparatus for performing rolling.

Furthermore, in the method for producing the rolled material, when a process of covering outer side faces of the powder alloy rolling case is provided after the accommodation process and before the rolling process, the joints of the case does not preferably appear on the surface of the completed product.

Various aspects and effect, and other effect and more features of the invention may be more apparent by detailed descriptions of an exemplified and nonrestrictive embodiment of the invention described later with reference to attached drawings.

BRIEF DESCRIPTION OF THE DRAWINGS

FIG. 2A is a plan view; and FIG. 2B is a longitudinal section view.

BEST MODE(S) FOR CARRYING OUT THE INVENTION

An embodiment of the present invention will be described with reference to drawings. In addition, in a description hereafter, a same symbol will be use for a same element and a duplicate description thereof will be omitted.

Figure 1:
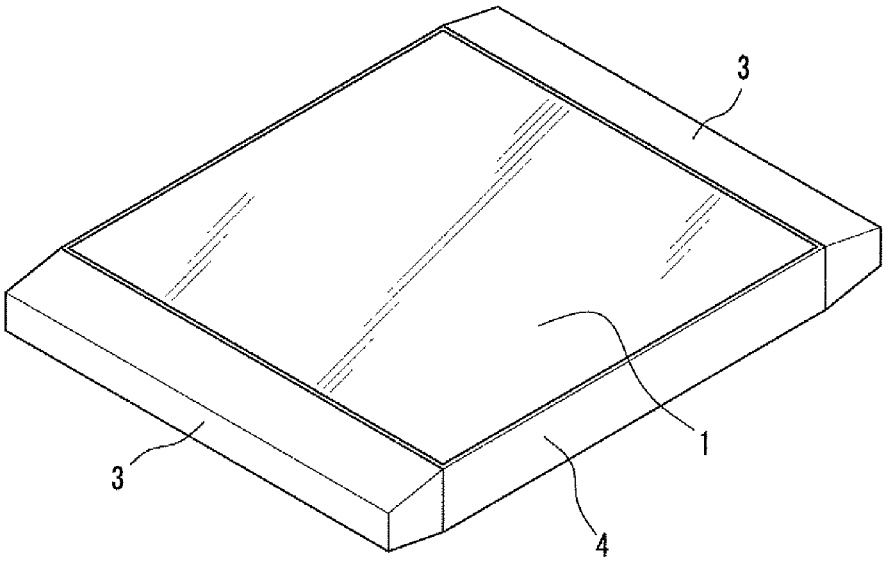
FIG. 1 is a perspective view wholly showing a powder alloy rolling case relating to an embodiment of the present invention.
Figure 2A:
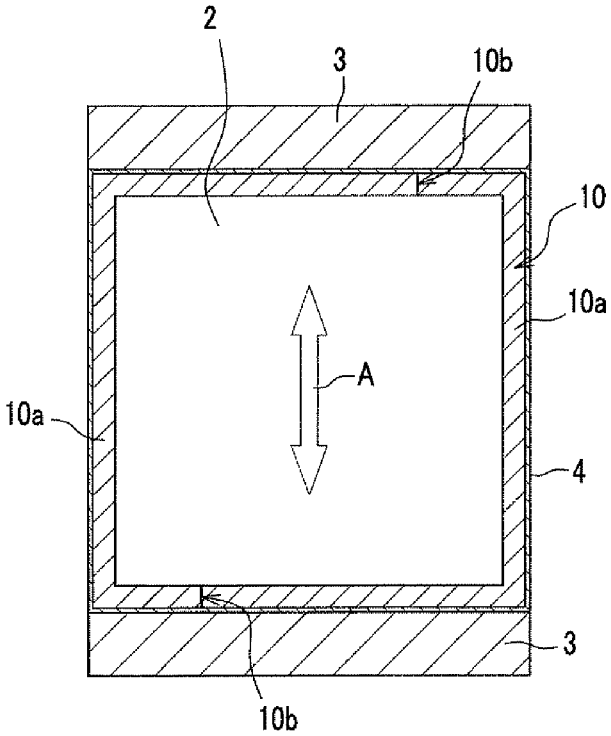
FIGS. 2A and 2B are drawings showing the powder alloy rolling case relating to the embodiment.
Figure 2B:
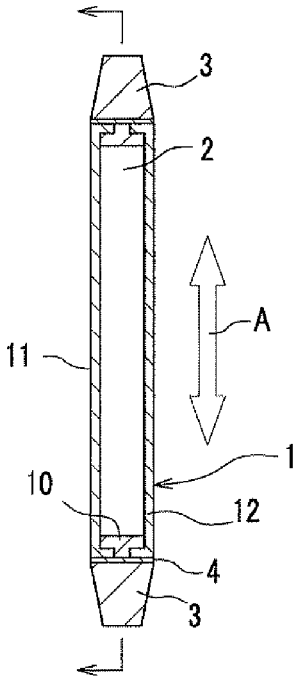

A method for producing a rolled material relating to the embodiment is, as shown in FIGS. 1, 2A, and 2B, a process of pressure-sintering a metal powder aggregate (hereinafter simply referred to as "metal powder") 2 in a state of the metal powder 2 being accommodated in a powder alloy rolling case 1 formed like a box; and then rolling the case 1. To front and rear faces (faces intersecting a rolling direction) of the powder alloy rolling case 1 with respect to the rolling direction are integrally fixed rolling reinforcing members 3, respectively. Furthermore, side faces of the powder alloy rolling case 1 are covered with a metal foil 4.

The powder alloy rolling case 1 is, as shown in FIGS. 2A and 2B, formed by: a side face configuring member 10 formed like a rectangular frame and covering side faces of the metal powder 2 compression-molded; an upper lid configuring member 11 provided to cover one opening of the member 10, and covering an upper face of the metal powder 2; and a lower lid configuring member 12 provided to cover the other opening of the member 10, and covering a lower face of the metal powder 2. A material configuring the powder alloy rolling case 1 is not limited if it is a metal; for example, the material is composed of any of aluminum, stainless steel, and the like.

The side face configuring member 10 is, as shown in FIGS. 2A and 2B, configured a rectangular barrel (rectangular frame) where a space for accommodating the metal powder 2 is formed by combining two members 10*a*, 10*a*.

As shown in FIG. 2A, joints 10*b*, 10*b* between the members 10*a*, 10*a* configuring the side face configuring member 10 are provided on opposing two side faces out of four side faces of the member 10. Then the joints 10*b*, 10*b* are arranged at positions displaced from middle portions in a width direction of the side faces (left-to-right direction in FIG. 2A).

According to the embodiment, one joint 10*b* formed on one side face (upper side in FIG. 2A), and the other joint 10*b* formed on the other side face (lower side in FIG. 2A) are arranged at the positions displaced from middles of the side faces by a same distance in the right direction and in the left direction in plan view, respectively. Accordingly, both of the members 10*a*, 10*a* are formed into a same shape.

In addition, according to the embodiment, although it is assumed that the side face configuring member 10 is configured with the two members 10*a*, 10*a*, a division number of the member 10 is not limited and may be selected as needed. Furthermore, the two members 10*a*, 10*a* are not always required to be formed into a same shape.

Figure 3:
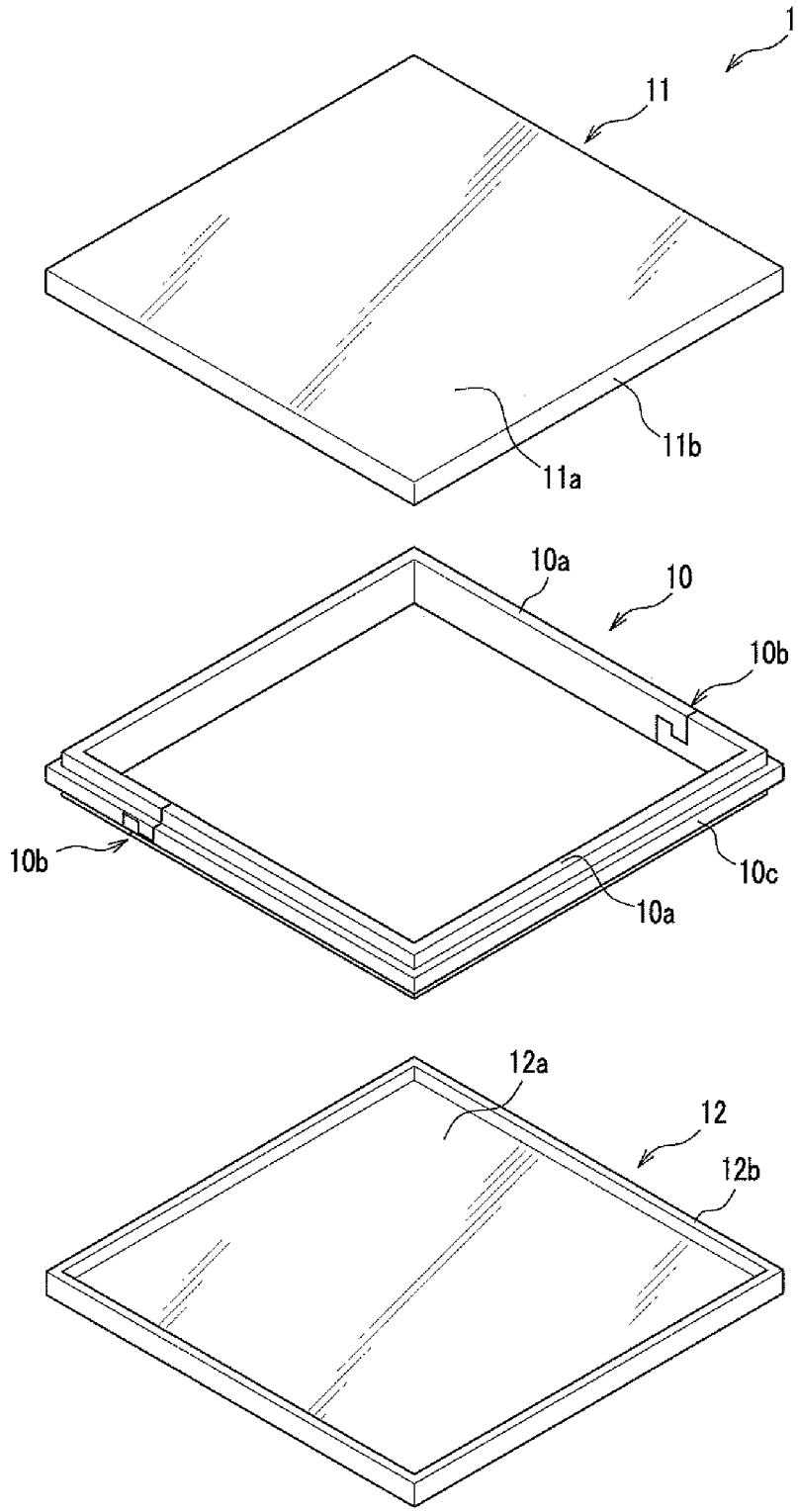
FIG. 3 is an exploded perspective view showing the powder alloy rolling case relating to the embodiment.
Figure 5A:
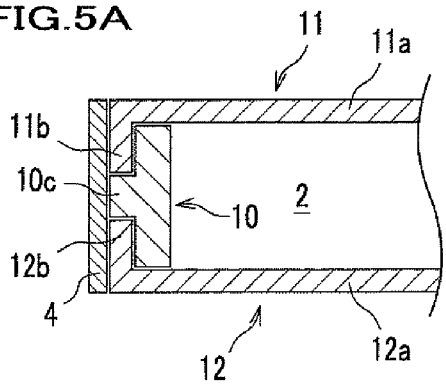
FIGS. 5A-5G are partial section views showing respective joints of respective side face configuring members, upper lid configuring members, and lower lid configuring members of the powder alloy rolling case relating to the embodiment.

As shown in FIGS. 3 and 5A, on an outer peripheral surface of the side face configuring member 10 is formed a protrusion strip 10*c* at a middle of the member 10 in a height direction along a perimeter direction thereof. The protrusion strip 10*c* is protruded from the side face configuring member 10 so as to be a same height (thickness) as a thickness of edge walls 11*b*, 12*b* of the upper lid configuring member 11 and the lower lid configuring member 12 described later. Then the side face configuring member 10, the upper lid configuring member 11, and the lower lid configuring member 12 are fitted by inserting a portion upper than the protrusion strip 10*c* of the side face configuring member 10 in a space formed by the edge wall 11*b* of the upper lid configuring member 11; and by inserting a portion lower than the strip 10*c* in a space formed by the edge wall 12*b* of the lower lid configuring member 12.

Figure 4A:
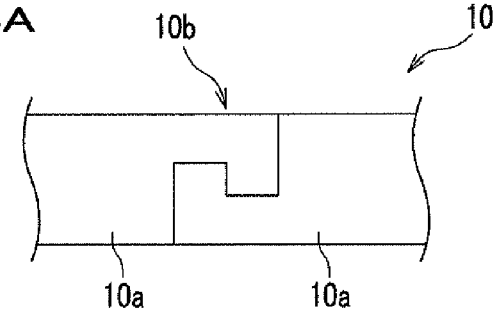
FIGS. 4A-4D are side views showing respective joints of respective side face configuring members of the powder alloy rolling case relating to the embodiment.

Ends (place corresponding to the joint lob) of the members 10*a*, 10*a* configuring the side face configuring member 10 are, as shown in FIGS. 3 and 4A, formed like a hook, and are formed so as to be fitted with each other at the joint 10*b*. Accordingly, with respect to the side face configuring member 10, because the members 10*a*, 10*a* are fitted with each other at the joint 10*b*, it is prevented for the joint 10*b* to open due to stress in rolling.

The upper lid configuring member 11 comprises, as shown in FIG. 3, a rectangular plate-form lid member body 11*a* formed according to an outer peripheral shape of the side face configuring member 10; and the edge wall 11*b* vertically provided at a peripheral edge of the body 11*a*.

The upper lid configuring member 11 is, as shown in FIG. 5A, arranged so that the edge wall 11*b* covers an outer peripheral surface of the portion upper than the protrusion strip 10*c* of the side face configuring member 10; thereby the member 11 is fitted with the member 10.

The lower lid configuring member 12 comprises, as shown in FIG. 3, a rectangular plate-form lid member body 12*a* formed according to the outer perimeter shape of the side face configuring member 10; and the edge wall 12*b* vertically provided at a peripheral edge of the body 12*a*.

The lower lid configuring member 12 is, as shown in FIG. 5A, arranged so that the edge wall 12*b* covers a peripheral surface of the portion lower than the protrusion strip 10*c* of the side face configuring member 10; thereby the member 12 is fitted with the member 10.

Thus the side face configuring member 10 and the upper lid configuring member 11, and the member 10 and the lower lid configuring member 12 are fitted; thereby the powder alloy rolling case 1 is configured.

The rolling reinforcing members 3 are, as shown in FIG. 1, members fixed to the front and rear side faces of the powder alloy rolling case 1, and in each of the members 3, a section where tapers are formed is formed into a trapezoid so that the nearer a top end of the member 3 is, the thinner a thickness thereof becomes. Due to each of the rolling reinforcing members 3 formed so that a thickness of the top end is thin, rolling load in rolling tends to be easily applied to the side face configuring member 10. In addition, according to the embodiment, although the rolling reinforcing members 3 are configured to be fixed to the faces intersecting the rolling direction of the powder alloy rolling case 1, the members 3 are not limited thereto; the members 3 may be arranged so as to cover the outer side faces of the case 1. Furthermore, according to the embodiment, as shown in FIG. 2B, it is configured that the thickness (height) of the rolling reinforcing members 3 on the sides of the powder alloy rolling case 1 is equal to the thickness (height) of the case 1; however, by slightly thinning the thickness of the rolling reinforcing members 3, pressure may also be applied to the powder alloy rolling case 1 from an initial stage in rolling.

As shown in FIG. 1, the metal foil 4 covers the outer side faces of the powder alloy rolling case 1, and on the side faces, conceals the joints of the side face configuring member 10 to the upper lid configuring member 11 and the lower lid configuring member 12. Thus a groove (line) of each joint 10 does not appear on the side faces of a completed product (aluminum powder alloy). In addition, the metal foil 4 may be provided as needed, and is not always required to be provided.

A method for producing a rolled material relating to the embodiment includes an accommodation process of accommodating the metal powder 2 in the powder alloy rolling case 1; a metal foil providing process of covering the side faces of the case 1, where the powder 2 is accommodated, with the metal foil 4; a sintering process of producing a clad material by sintering the case 1 covered with the foil 4; and a rolling process of rolling the clad material.

In the accommodation process the upper and lower faces of the metal powder 2 are covered with the upper lid configuring member 11 and the lower lid configuring member 12, respectively, in a state of the powder 2 being accommodated in an inner space of the side face configuring member 10 configured by combining the members 10*a*, 10*a* with each other. At this time, the metal powder 2 and the powder alloy rolling case 1 are closely in contact with each other. Furthermore, the side face configuring member 10, the upper lid configuring member 11, and the lower lid configuring member 12 are fitted in a state of the outer peripheral surface of the portion upper than the protrusion strip 10*c* of the member 10 and the edge wall 11*b* of the member 11 being closely in contact with each other; and the outer peripheral surface of the portion lower than the protrusion strip 10*c* of the member 10 and the edge wall 12*b* of the member 12 closely in contact with each other. In addition, it is assumed in the embodiment that a tentative powder molded product where mixed powder of aluminum and ceramic is solidified in advance into a predetermined shape is used as the metal powder 2. Here, the metal powder (tentative powder molded product) 2 is, for example, molded so that a tap density thereof is 1.65 by a 100 ton press machine, and is solidified to the extent that the density is small and the powder 2 is easily collapsed by handling and the like.

With respect to assembling the powder alloy rolling case 1, the metal powder 2 may be arranged in advance at a predetermined place, and then the side face configuring member 10, the upper lid configuring member 11, and the lower lid configuring member 12 may be assembled so as to cover the perimeter of the powder 2; and the powder 2 may also be inserted in the member 10 assembled in advance; thus an order of assembling the case 1 is not limited.

In addition, a molding method and the like of the metal powder (tentative powder molded product) 2 are not limited; the powder 2 may be molded according to a known method as needed. Furthermore, a material composing the metal powder 2 is not limited; it may be selected according to the usage of an aluminum powder alloy as needed; for example, it may be composed of only aluminum. Moreover, the metal powder 2 may also be directly accommodated in the powder alloy rolling case 1 in a powder state without using the tentative powder molded product as the metal powder 2.

In the metal foil providing process the joints of the side face configuring member 10 to the upper lid configuring member 11 and the lower lid configuring member 12 are not exposed by covering the outer side-faces of the powder alloy rolling case 1, where the metal powder 2 is accommodated, with the metal foil 4.

The sintering process is a process of applying current pressure sintering to the powder alloy rolling case 1 where the metal powder 2 is accommodated. The current pressure sintering may be performed according to a known method: for example, a vacuum container is tightly sealed; an inside of a sintering furnace is made a state of reduced pressure by a vacuum pump and the like; an inert ambient gas is filled in the vacuum container as needed; then an upper punch member and a lower punch member are actuated; a material in molding dies is pressed and compressed by predetermined pressure; then a direct-current pulse current is passed to an obtained high density compressed product through the upper punch member and the lower punch member; and the material is pressure sintered. The current pressure sintering is performed, for example, under a vacuum ambience equal to or less than 0.1 torr of vacuum, and under a condition of: current, 5000 to 30000 amperes; temperature rise speed, 10 to 300 degrees Celsius/min; sintering temperature, 500 to 650 degrees Celsius; holding time, equal to five minutes or more; and pressure, 5 to 10 MPa.

The rolling process is a process of: fixing the rolling reinforcing members 3 to the clad material, which is current pressure sintered in the sintering process, by welding and the like; then elongating the clad material while adding pressure from upside and downside thereof; and thereby producing an aluminum powder alloy (producing the rolled material). It is assumed that the clad material is rolled in a direction (rolling direction A) orthogonal to the faces where the joints 10*b* are arranged. Then after the rolling is performed sufficiently in the rolling direction A, the clad material is turned as needed, and rolling is performed in another direction. In addition, the rolling reinforcing members 3 may be current pressurized together with the powder alloy rolling case 1 in the sintering process.

In addition, after the sintering process and before the rolling process, there may also be provided, as needed, a welding process of welding and joining the side face configuring member 10 to upper lid configuring member 11 and lower lid configuring member 12 of the clad material.

In the welding process the protrusion strip 10*c* of the side face configuring member 10 are welded and joined to the edge wall 11*b* of the upper lid configuring member 11 and the edge wall 12*b* of the lower lid configuring member 12. According to the powder alloy rolling case 1 relating to the embodiment, because it is possible on the side faces of the clad material to weld and join the side face configuring member 10 to the upper lid configuring member 11 and the lower lid configuring member 12, a weld bead is not formed on the upper and lower faces of the clad material, and the case 1 does not badly affect a rolling work. That is, there does not occur a trouble that a depression and a protrusion are formed on the upper and lower faces of the clad material due to the weld bead, and that rolling pressure does not uniformly act. Accordingly, because a work for grinding down the weld bead is not required, it is possible to reduce manpower and cost in the welding process.

Thus according to the method for producing the powder alloy rolling case 1 and rolled material of the embodiment, because the joints 10*b*, 10*b* between the members 10*a*, 10*a* are not arranged at the corners of the powder alloy rolling case 1 where a large force is applied in rolling, no breakage preferably occurs in the case 1.

Furthermore, because joining the members 10*a*, 10*a* with each other is performed by fitting the members 10*a*, 10*a* with each other, those are integrated by pressure sintering, and any of the joints 10*b*, 10*b* is not opened in rolling. Furthermore, the joints 10*b*, 10*b* are arranged at the positions displaced from the middles of the faces intersecting the rolling direction A where a tension in rolling acts most; thereby the breakage of the powder alloy rolling case 1 is prevented.

Furthermore, with respect to joining the side face configuring member 10 to the upper lid configuring member 11 and the lower lid configuring member 12, because the edge walls 11*b*, 12*b* of the members 11 and 12 are fitted to cover the outer peripheral surface of the member 10, it is prevented to generate a breakage in rolling due to an intervention of metal powder between the member 11 or 12 and the member 10.

Because the side faces of the powder alloy rolling case 1 are covered with the metal foil 4, the joints of the side face configuring member 10 to the upper lid configuring member 11 and the lower lid configuring member 12 are not exposed outside. Therefore, a degree of freedom is increased in the usage of a produced aluminum alloy.

Because the rolling reinforcing members 3 are fixed in advance in rolling, it is possible to efficiently perform a rolling work, and the powder alloy rolling case (clad material) 1 is reinforced and so the breakage of the case 1 does not occur.

Thus the embodiment of the present invention has been described, the invention is not limited to the embodiment, and can be changed in design within the spirit and scope of the invention as needed.

For example, in the embodiment, it is assumed before the rolling process that in the sintering process the current pressure sintering is applied to the powder alloy rolling case 1 where the metal powder 2 is accommodated, and that the clad material is produced; however, the sintering process may be omitted, and the case 1 where the metal powder 2 is accommodated may be rolled as it is.

Figure 4B:
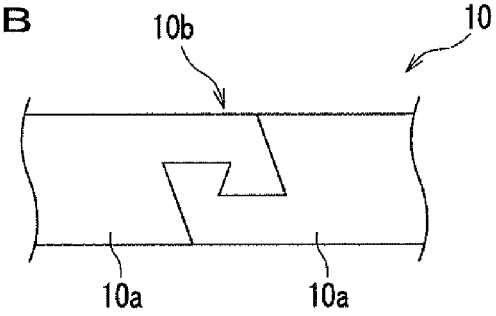
Figure 4C:
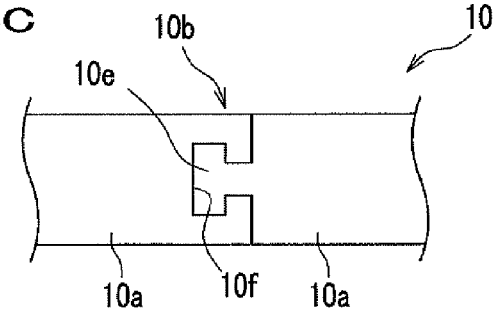

Furthermore, in the embodiment, as shown in FIG. 4A, it is configured at the joint 10*b* between the members 10*a*, 10*a* configuring the side face configuring member 10 that hook portions like an L-letter formed at respective ends are fitted, and thereby it is prevented for the joint 10*b* to be opened in the lateral direction thereof (the left-to-right direction in FIG. 4A); the shape of the ends is not limited thereto. That is, as shown in FIG. 4B, the hook portions may be configured in shape to be difficult to be separated also in an up-to-down direction. Furthermore, as shown in FIG. 4C, it may also be configured that: a protrusion 10*e* like a lateral T-letter is formed at an end of one member 10*a*, and a groove 10*f* formed to correspond to the shape of the protrusion 10*e* at an end of the other member 10*a*; and thereby, the hook portions may be fitted with each other. In addition, although it is assumed in FIG. 4C that the protrusion 10*e* is formed like the lateral T-letter, the shape thereof is not limited.

Figure 4D:
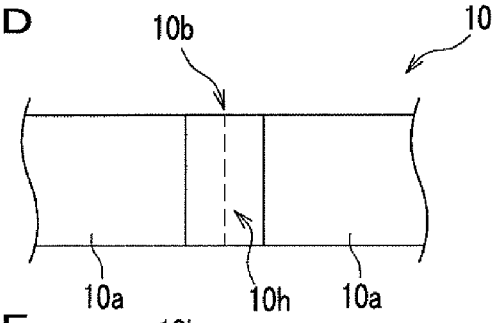
Figure 4E:
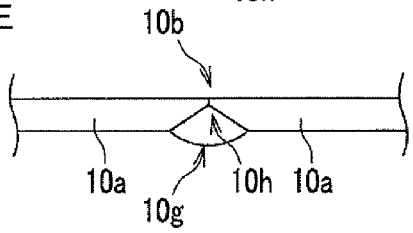
FIG. 4E is a plan view of FIG. 4D.

Furthermore, in the embodiment, although it is assumed that each of the joints 10*b*, 10*b* between the members 10*a*, 10*a* is joined by fitting the members 10*a*, 10*a*, the joining method is not limited thereto; the joint 10*b* may also be joined by a known joining method as needed. For example, as shown in FIGS. 4D and 4E, the members 10*a*, 10*a* may be joined by welding. In addition, in FIG. 4D tapers are formed at the ends of the members 10*a*, 10*a*, respectively, and an opened tip 10*h* of a V-shape is formed at the joint lob; and thereby, a protruded portion of a weld bead 10*g* is made small.

Furthermore, in the embodiment, although it is assumed as shown in FIG. 5A that the protrusion strip 10*c* is formed on the outer peripheral surface of the side face configuring member 10, the shape of the member 10 is not limited thereto. For example, as shown in FIG. 5B, the outer peripheral surface of the side face configuring member 10 may also be a flat surface without the protrusion strip 10*c* (see FIG. 5A). In this instance the edge walls 11*b*, 12*b* of the upper lid configuring member 11 and the lower lid configuring member 12 may be arranged along the outer peripheral surface of the side face configuring member 10. In addition, as shown in FIG. 5C, it may also be configured that the edge wall 11*b* is formed either in the upper lid configuring member 11 or in the lower lid configuring member 12, and that the outer peripheral surface of the side face configuring member 10 is covered therewith.

Furthermore, as shown in FIG. 5B, with respect to the joints of the side face configuring member 10 to the edge walls 11*b*, 12*b*, an aluminum tape 13 and the like may be stuck to a seam thereof. According to this, the seam is shielded and its being opened is prevented, and it is prevented for the metal powder 2 to be pulled out through the seam in rolling. Furthermore, the aluminum tape 13 is stuck to the seam, and thereby, the seam of the joints of the side face configuring member 10 to the edge walls 11*b*, 12*b* is not exposed outside. Furthermore, as shown in FIG. 5C, when the upper lid configuring member 11 and the lower lid configuring member 12 are directly joined, the aluminum tape 13 and the like may also be stuck to the seam of the joint. In addition, it goes without saying that the aluminum tape 13 may be stuck as needed.

Figure 5E:
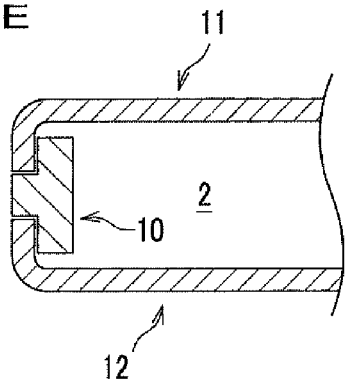
Figure 5B:
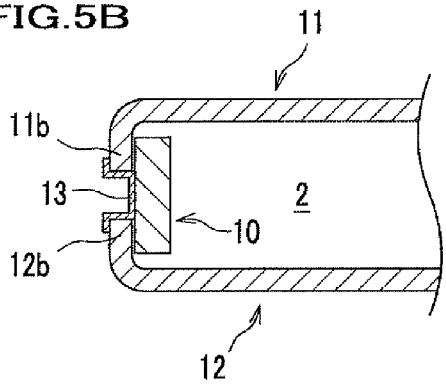
Figure 5F:
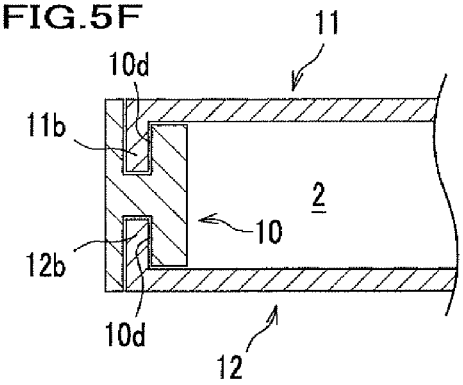
Figure 5C:
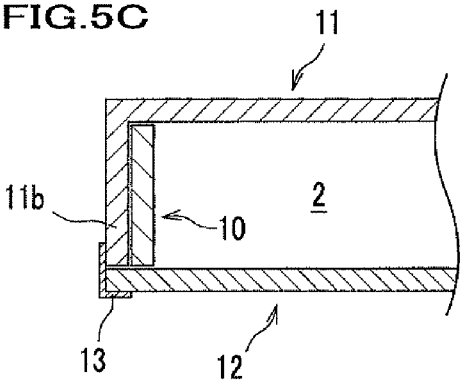
Figure 5G:
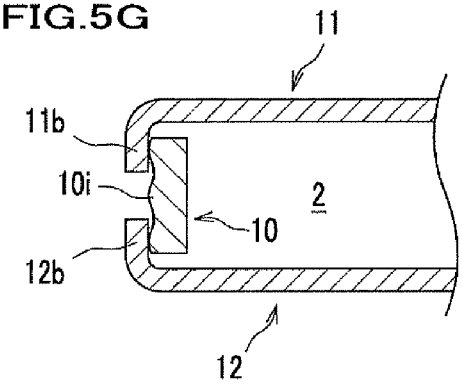
Figure 5D:
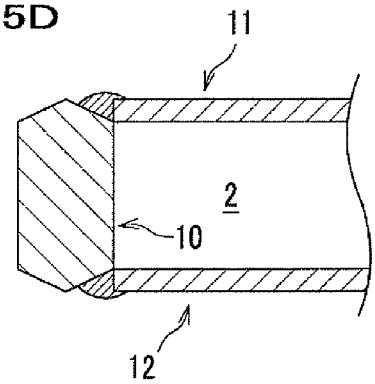
Figure 6A:
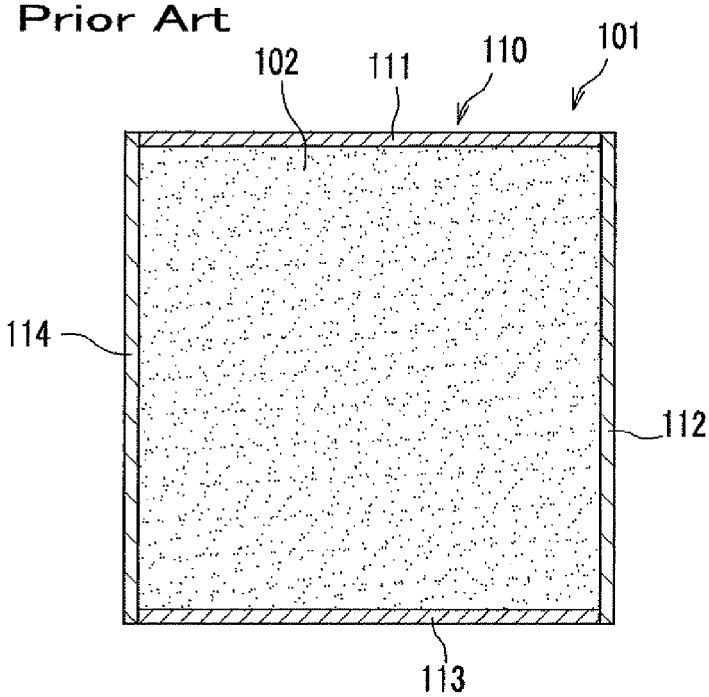
FIG.6A Prior Art
FIGS. 6A and 6C are plan section views showing a conventional powder alloy rolling case.
Figure 6B:
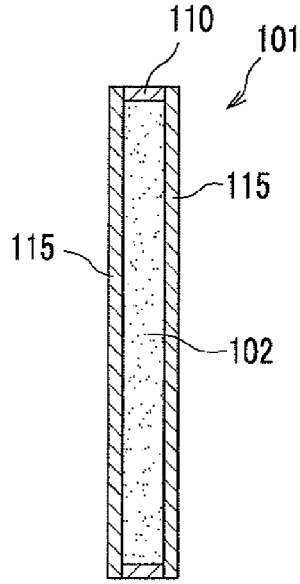
FIG.6B Prior Art
FIGS. 6B and 6D are longitudinal section views of the same.
Figure 6C:
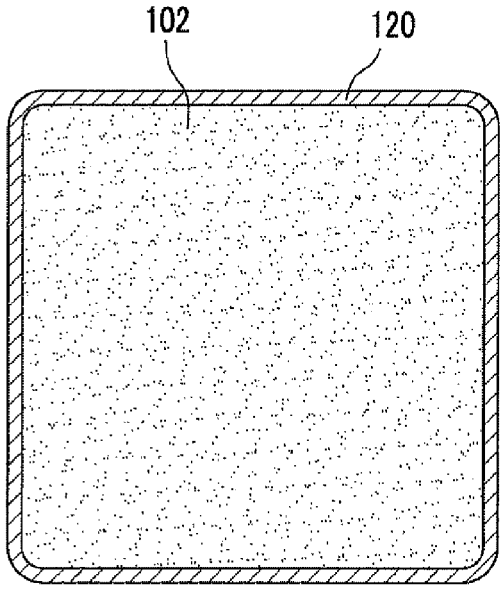
FIG.6C Prior Art
Figure 6D:
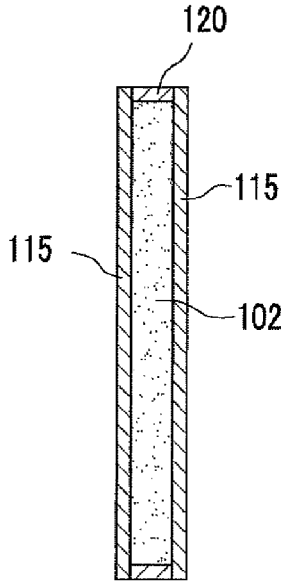
FIG.6D Prior Art

Furthermore, it is not always necessary to form the edge walls 11*b*, 12*b* in the upper lid configuring member 11 and the lower lid configuring member 12, and as shown in FIG. 5D, the members 11 and 12 may be configured to be joined to the upper face and lower face of the side face configuring member 10, respectively. In this instance a joining method of the side face configuring member 10 to the upper lid configuring member 11 and the lower lid configuring member 12 is not limited; for example, the method may also be according to a known method as needed. Furthermore, it may also be configured that the powder alloy rolling case 1 is integrated by being pressure sintered in a state of the upper lid configuring member 11 and the lower lid configuring member 12 being placed on the upper face and lower face of the side face configuring member 10, respectively.

Furthermore, in the embodiment, although the side faces of the side face configuring member 10 are configured to be covered with the metal foil 4, the foil 4 may also be omitted as shown in FIG. 5E when it is permitted that lines of the joints of the side face configuring member 10 to the upper lid configuring member 11 and the lower lid configuring member 12 are exposed to the side faces of the completed product. Furthermore, it may also be configured as shown in FIG. 5F, as the side face configuring member 10, that depressions 10*d*, 10*d* where the edge walls 11*b*, 12*b* of the upper lid configuring member 11 and the lower lid configuring member 12 can be inserted are formed at an approximately middle of the member 10 in a thickness direction, and thereby the joints are not exposed outside.

Furthermore, with respect to the side face configuring member 10, it may also be configured that: the outer peripheral surface thereof is cut off and a concave and convex face 10*i* of a corrugated shape is formed as shown in FIG. 5G; and the member 10 is easily compressed in rolling. Thus by forming the concave and convex face 10*i* in the side face configuring member 10, it is possible in rolling to prevent the member 10 from being buckled and to form aluminum alloy powder into a desired shape. In addition, the shape of the concave and convex face 10*i* is not limited and can be selected as needed; however, a section area of the side face configuring member 10 is preferably around 80% of an area including the cut-off portion of the face 10*i*. Furthermore, in FIG. 5G, although the concave and convex face 10*i* is formed only on the outer peripheral surface of the side face configuring member 10, the concave and convex face 10*i* may also be formed on any of an inner peripheral surface and both peripheral surfaces thereof.

Furthermore, in the embodiment, although it is assumed that the joints 10*b*, 10*b* between the members 10*a*, 10*a* configuring the side face configuring member 10 are formed on the faces intersecting the rolling direction A, the members 10*a*, 10*a* may be jointed on faces parallel to the rolling direction A when the members 10*a*, 10*a* are firmly joined with each other and the joints 10*b*, 10*b* are not opened.

Furthermore, when the members 10*a*, 10*a* are firmly joined with each other and the joints 10*b*, 10*b* are not opened, the joints 10*b*, 10*b* between the members 10*a*, 10*a* may also be arranged at the middles of the faces in the width direction, wherein the faces intersect the rolling direction A.

The invention claimed is:

1. A method for producing a rolled material comprising:

an accommodation process of accommodating metal powder in a case for rolling a powder alloy, wherein the case is formed like a box by a side face configuring member configured to be formed like a rectangular frame with a plurality of members combined and to surround side faces of metal powder, an upper lid configuring member configured to be provided to cover one opening of the side face configuring member and to cover an upper face of the metal powder, and a lower lid configuring member configured to be provided to cover the other opening of the side face configuring member and to cover a lower face of the metal powder; and a rolling process of rolling the case where the metal powder is accommodated, wherein joints between the plurality of members of the side face configuring member are arranged in opposing two side faces out of four side faces of the side face configuring member, and the joints are located within the opposing two side faces apart from corners of the side face configuring member, and wherein in the rolling process the case is rolled in a direction intersecting the opposing two side faces where the joints are formed.

2. The method according to claim 1, wherein a process of sintering the case where the metal powder is accommodated is included after the accommodation process and before the rolling process.

3. The method according to claim 1, wherein rolling reinforcing members are fixed to the opposing two side faces where the joints are formed.

4. The method according to claim 1, further comprising a process of covering outer side faces of the case after the accommodation process and before the rolling process.

5. The method according to claim 1, wherein the joints of the opposing two side faces are each located between a corner of the side face configuring member and a middle of a corresponding side face.

6. The method according to claim 5, wherein the joints of the opposing two side faces are offset one from the other.

7. The method according to claim 1, wherein the joints between the plurality of members comprise one or more configurations of a hook, a protrusion, and a groove.

* * * * *